US007673420B2

(12) United States Patent
Madesh

(10) Patent No.: US 7,673,420 B2
(45) Date of Patent: Mar. 9, 2010

(54) METHOD AND APPARATUS FOR MAKING A CORNER BENCH IN A TILED SHOWER

(75) Inventor: Greg Madesh, Redmond, OR (US)

(73) Assignee: Eazy Company, LLC, Redmond, WA (US)

( * ) Notice: Subject to any disclaimer, the term of this patent is extended or adjusted under 35 U.S.C. 154(b) by 334 days.

(21) Appl. No.: 11/903,409

(22) Filed: Sep. 21, 2007

(65) Prior Publication Data

US 2009/0077903 A1 Mar. 26, 2009

(51) Int. Cl.
*A47K 3/12* (2006.01)
*E04B 1/02* (2006.01)

(52) U.S. Cl. ..... 52/34; 52/747.11; 52/389; 4/611

(58) Field of Classification Search ..... 52/35, 52/36.4, 36.5, 262, 389, 390, 747.1, 749.1, 52/747.11; 4/611, 612, 614; 108/42; 29/897.3; 156/71, 574; 211/90.01, 119.009, 134, 153; 248/220.1, 250, 200.1
See application file for complete search history.

(56) References Cited

U.S. PATENT DOCUMENTS

| | | | | |
|---|---|---|---|---|
| 2,036,184 | A * | 4/1936 | Armstrong | 108/101 |
| 2,182,600 | A | 12/1939 | Spetz et al. | |
| 3,089,439 | A * | 5/1963 | Hays | 108/152 |
| 3,640,041 | A | 2/1972 | Michieli | |
| 4,555,082 | A * | 11/1985 | Sack et al. | 248/220.1 |
| 4,886,236 | A * | 12/1989 | Randall | 248/250 |
| 5,542,218 | A | 8/1996 | Rompel | |
| 5,588,370 | A | 12/1996 | Longley | |
| 5,724,894 | A | 3/1998 | Knorovsky | |
| 5,732,421 | A | 3/1998 | Scherberger | |
| 5,755,343 | A * | 5/1998 | Harvey, Sr. | 211/90.01 |
| 6,052,845 | A | 4/2000 | Harvey | |
| 6,260,489 | B1 * | 7/2001 | Weaver et al. | 108/152 |
| 6,301,725 | B1 | 10/2001 | Harvey | |
| 6,588,030 | B1 | 7/2003 | Wulff | |
| 2005/0040124 | A1 | 2/2005 | Fontana et al. | |
| 2006/0156637 | A1 | 7/2006 | Blankenship et al. | |
| 2009/0025139 | A1 * | 1/2009 | Houpt | 4/578.1 |

FOREIGN PATENT DOCUMENTS

| | | |
|---|---|---|
| KR | 2006105926 | 4/2005 |
| KR | 2006105926 | 10/2006 |

OTHER PUBLICATIONS

Reply 5 by Armen Tavy: www.floorstransformed.com/ceramic-tile-forum/2004/bench-in-shower-15947.html.*

* cited by examiner

*Primary Examiner*—Robert J Canfield
*Assistant Examiner*—Christine T Cajilig
(74) *Attorney, Agent, or Firm*—Chernoff, Vilhauer, McClung & Stenzel, LLP

(57) ABSTRACT

A corner bench for a shower is constructed by placing a beam diagonally between adjacent walls of the shower. The ends of the beam are supported on the upwardly facing edges of tile pieces which are attached to the shower walls. The tile pieces are placed on the walls such that their upper edges are horizontal and are coplanar with the top of the beam. A triangular platform is then placed on top of the beam and the upper edges of these tile pieces to create the bench. Tile is then placed on top of the platform and the front of the beam to finish the bench.

16 Claims, 7 Drawing Sheets

METHOD AND APPARATUS FOR MAKING A CORNER BENCH IN A TILED SHOWER

BACKGROUND OF THE INVENTION

Residential showers often have a small bench located in one corner of the shower. While these benches are seldom sat on, they need to be strong enough to support a person without significant deflection which would cause the grout between the tile pieces to crack. While some of these benches extend to the floor of the shower, they often are cantilevered which makes it difficult to provide the necessary support. Heretofore, this support has been obtained by constructing a wood or metal frame which is tied to the underlying wall structure. This is expensive and requires that the support be built before wall border is applied to the shower walls, or if it is a retrofit, that the existing wall board be removed.

BRIEF SUMMARY OF THE INVENTION

The subject invention provides a method and apparatus for making a cantilevered bench in the corner of a shower without having to build a support that is tied to the underlying wall structure by providing a beam which extends diagonally between adjacent walls of the shower. The ends of the beam are supported by upwardly facing horizontal edges of tile pieces which are attached to the walls that form the corner in which the bench will be placed. Additional tile pieces having horizontal upper edges which are coplanar with the top of the beam are placed between the tile pieces that support the beam and the corner. A triangular platform is then placed on the beam and the horizontal upper edges of the additional tile pieces. Tile is then installed on the top of the platform, on the front of the beam, and on the rest of the shower wall as desired.

The foregoing and other objectives, features, and advantages of the invention will be more readily understood upon consideration of the following detailed description of the invention, taken in conjunction with the accompanying drawings.

DETAILED DESCRIPTION OF PREFERRED EMBODIMENT

Figure 1:
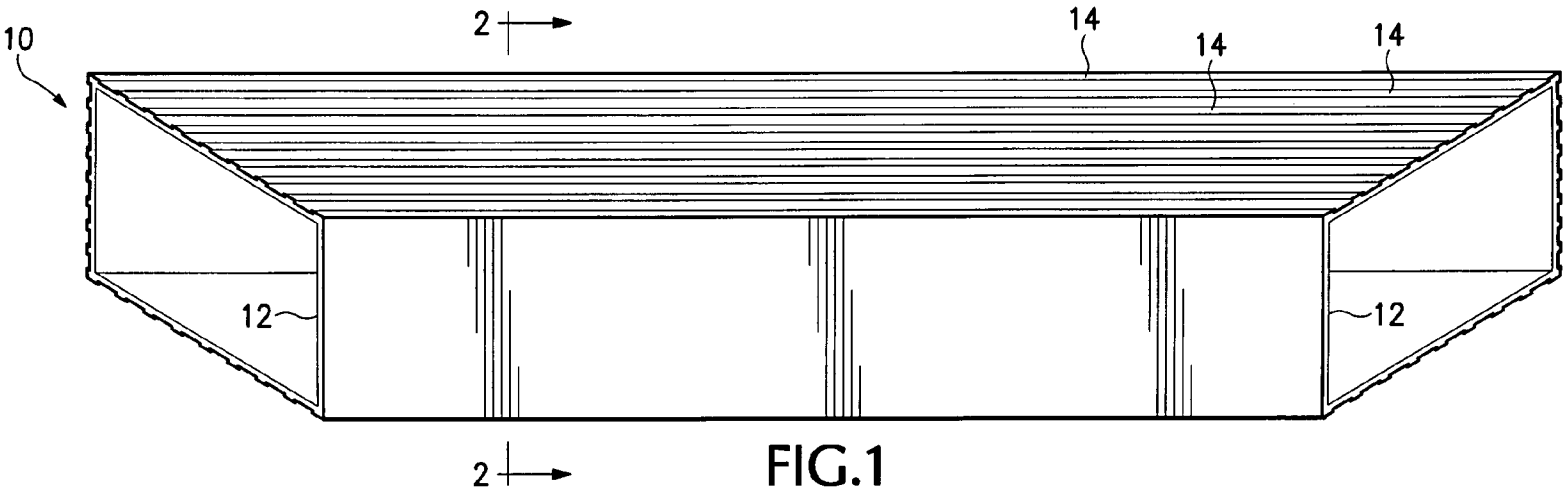
FIG. 1 is a perspective view of a beam which is an element of the subject invention.
Figure 2:
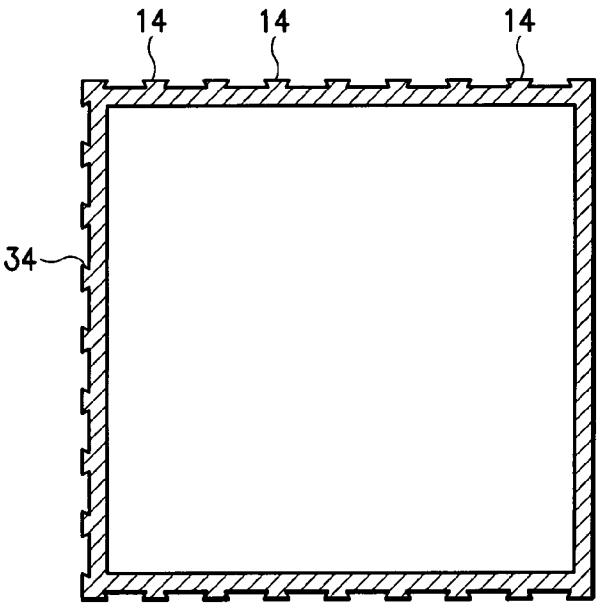
FIG. 2 is a cross-sectional view taken on lines 2-2 of FIG. 1.
Figure 3:
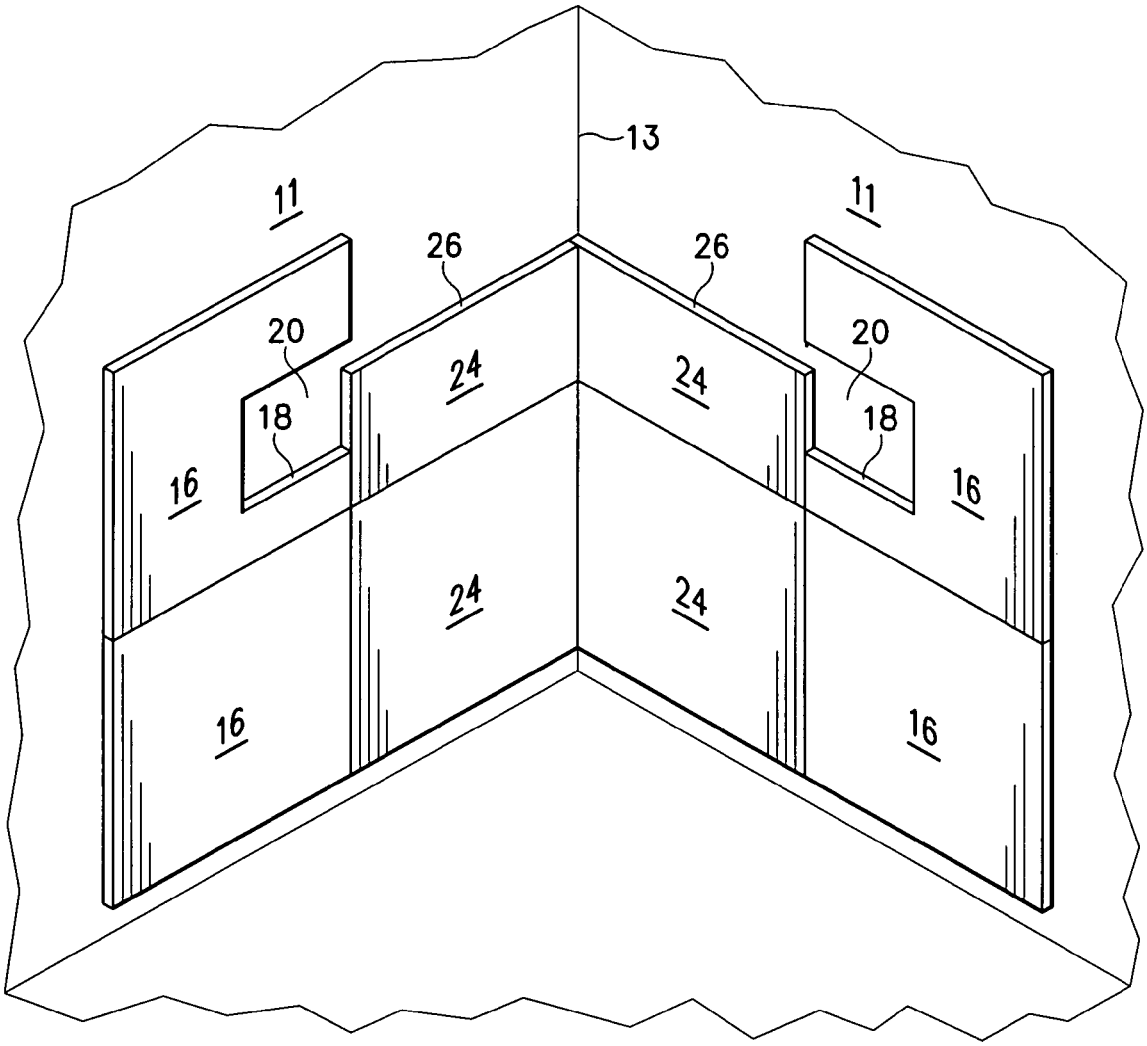
FIGS. 3-8 are perspective views showing the various steps in the method of the subject invention.
Figure 3:
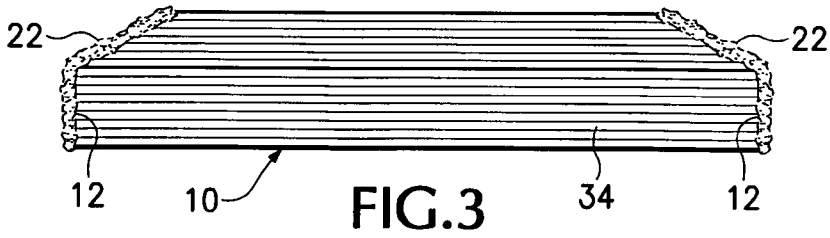

Referring to FIGS. 1-3 of the drawings, an elongate beam 10 has opposed ends 12 which are cut at an angle with respect to the longitudinal axis of the beam such that when the beam is placed diagonally between two perpendicular walls 11, which form a corner 13 of the shower, the ends of the beam are flush with the walls. Preferably, the beam is a hollow rectangular beam, and in the embodiment illustrated it is square in cross-section. Ridges 14 extend longitudinally along the top and the longer side surface of the beam, which forms its front side. In the embodiment illustrated the ridges are truncated triangles in cross-section which creates a mortise pattern on the top and front surfaces of the beam. In a preferred embodiment the beam is made from a plastic material and is formed by extrusion. However, the beam could have other shapes, be made from other materials, or have other surface treatments.

Figure 4:
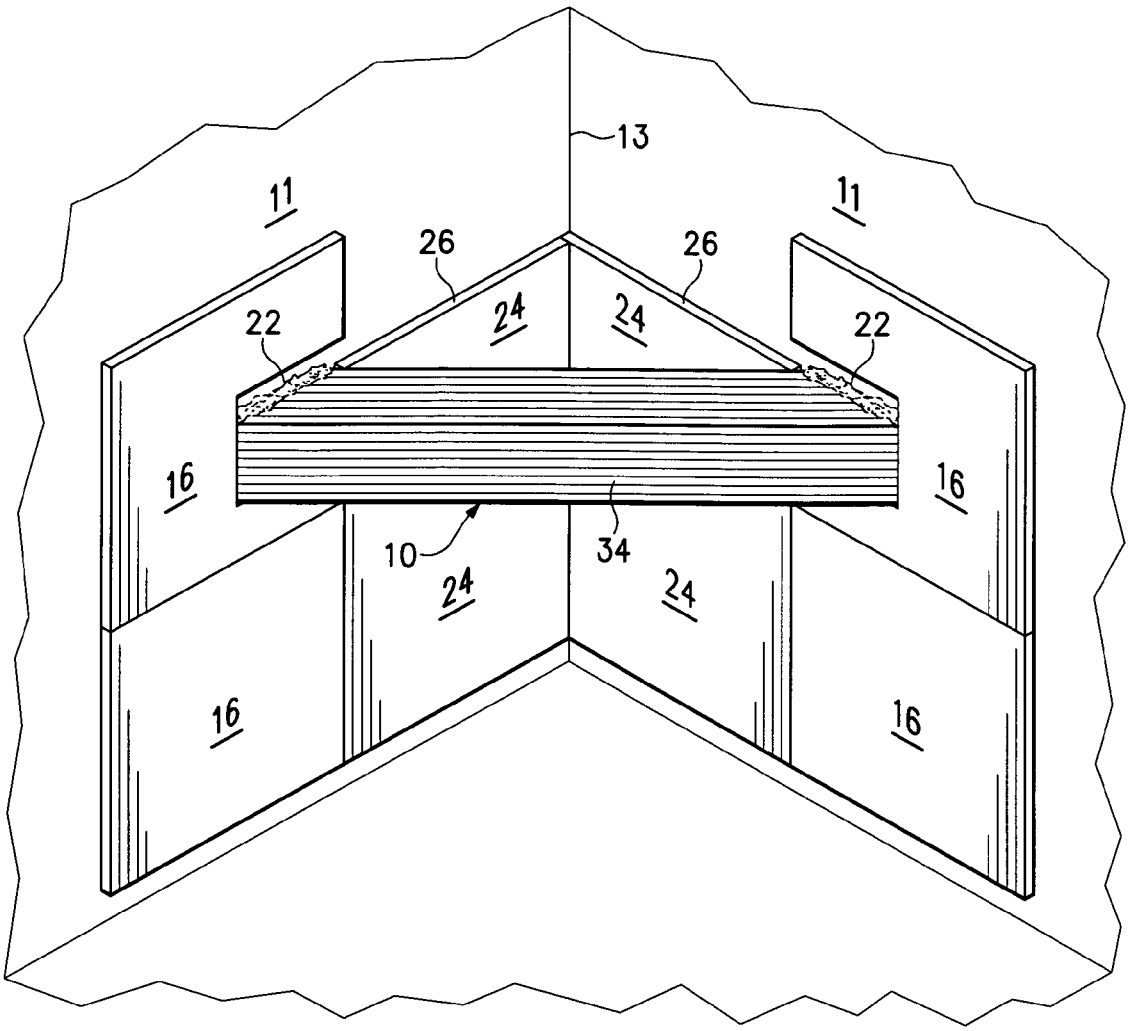

Referring now to FIGS. 3-9, a corner bench is formed using the beam 10 by installing tile pieces 16 having upwardly facing horizontal edges 18 on both walls outwardly from the corner 13 at a location where the extremities of the beam 10 rest on the edges 18 when the ends of the beam are placed against the walls 11, FIG. 4. In the embodiment illustrated, the upwardly facing horizontal edges 18 are located at the bottoms of slots 20 located in the vertical edges of the tile 16 which face toward the corner 13. However, the upwardly facing horizontal edges could be the upper edges of the tile 16. An adhesive 22 is placed on the ends 12 of the beam 10 before the ends of the beam are placed against the walls. The adhesive can be any material used for adhering tile to an underlying wall.

Tile pieces 24 are attached to the wall in the space between the tile pieces 16 and the corner 13. While the tile pieces 24 shown in the drawings are only a single column wide, there could be several columns of tile depending on the size of the tile and the size of the bench. The tile pieces 24 have horizontal upper edges 26 which are generally coplanar with the top surface of the beam 10 when the beam is placed on the upwardly facing horizontal edges 18 of the tile pieces 16. Typically the tile pieces 16 and 24 would be attached to the wall 11 at the same time and then the beam 10 would then be installed.

Figure 5:
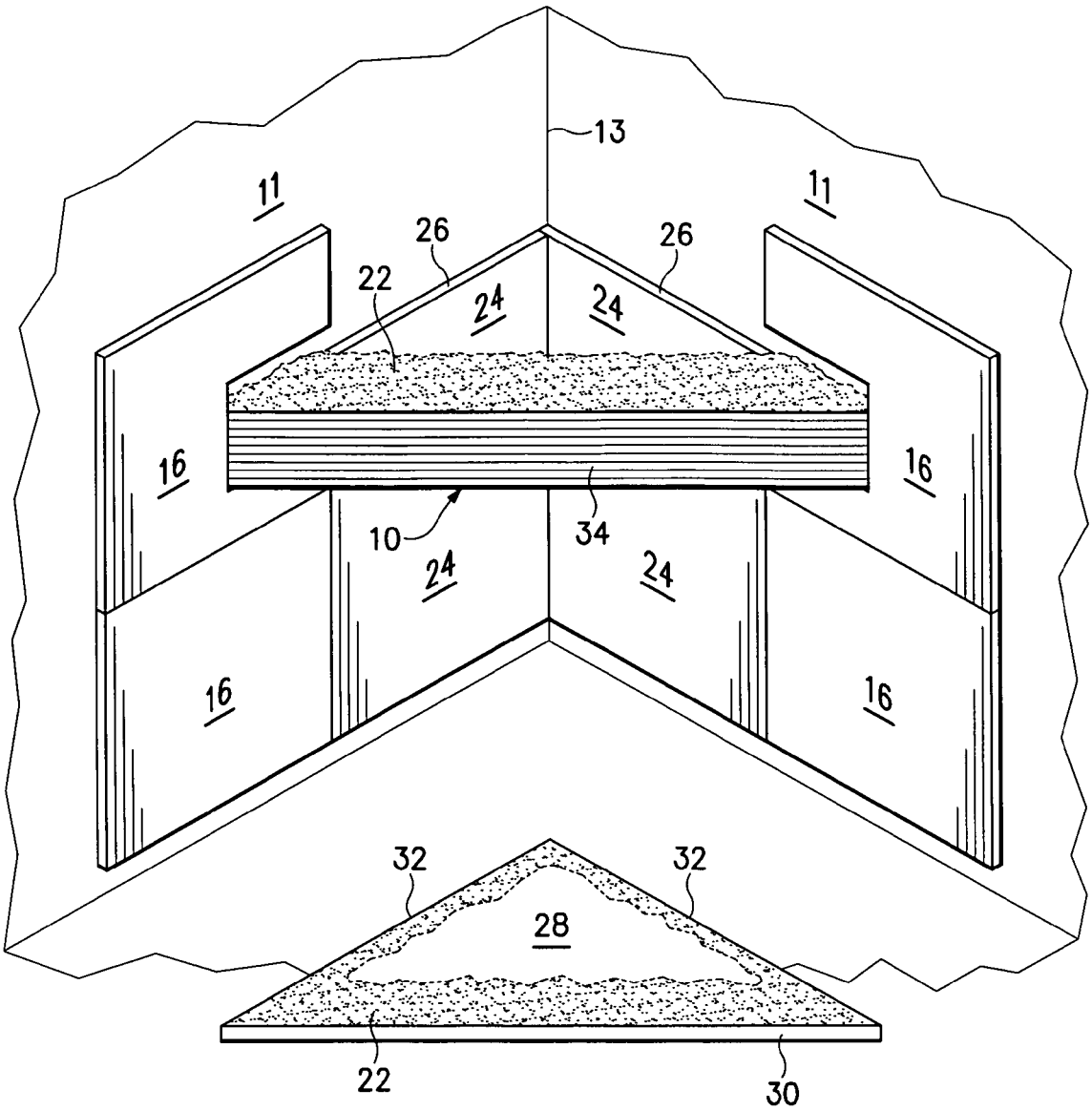
Figure 6:
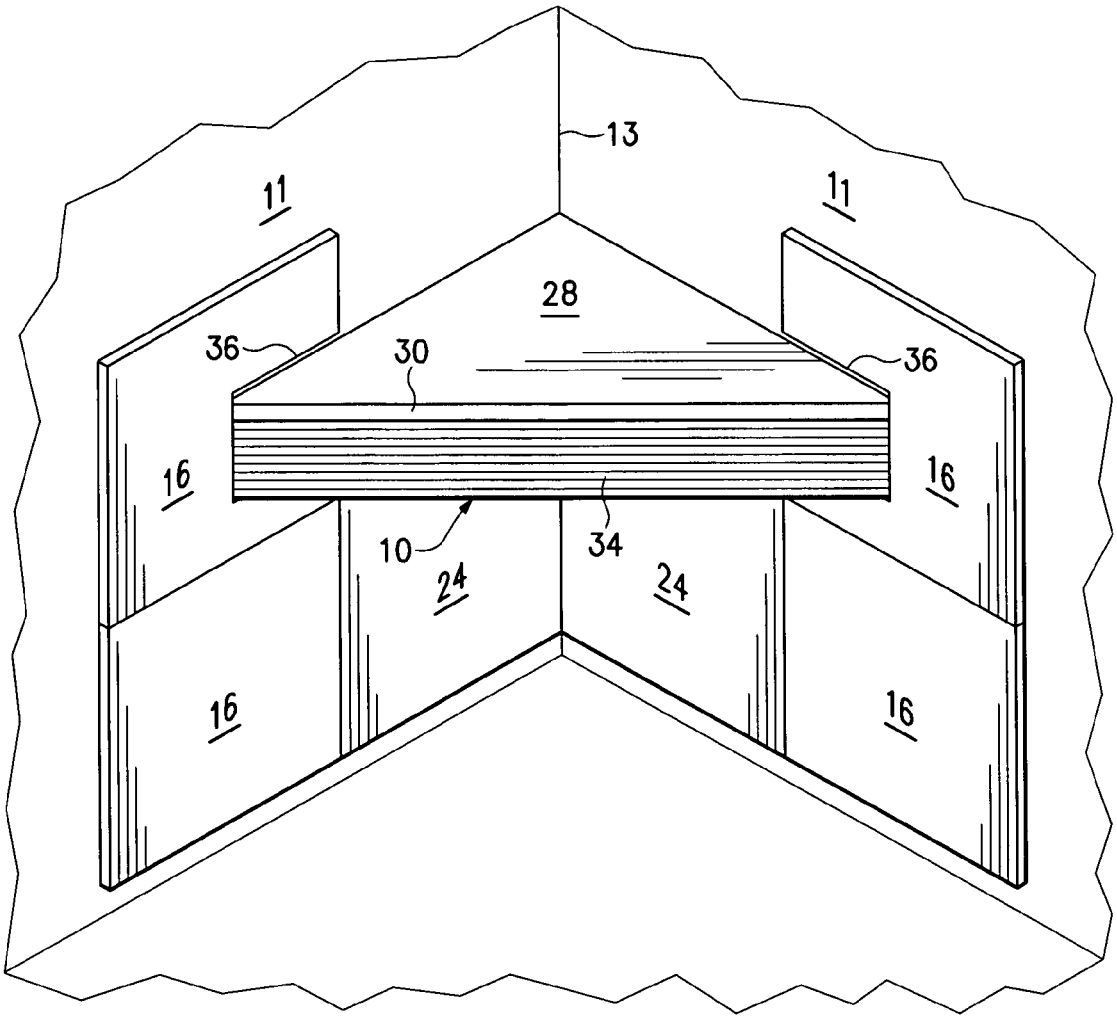
Figure 7:
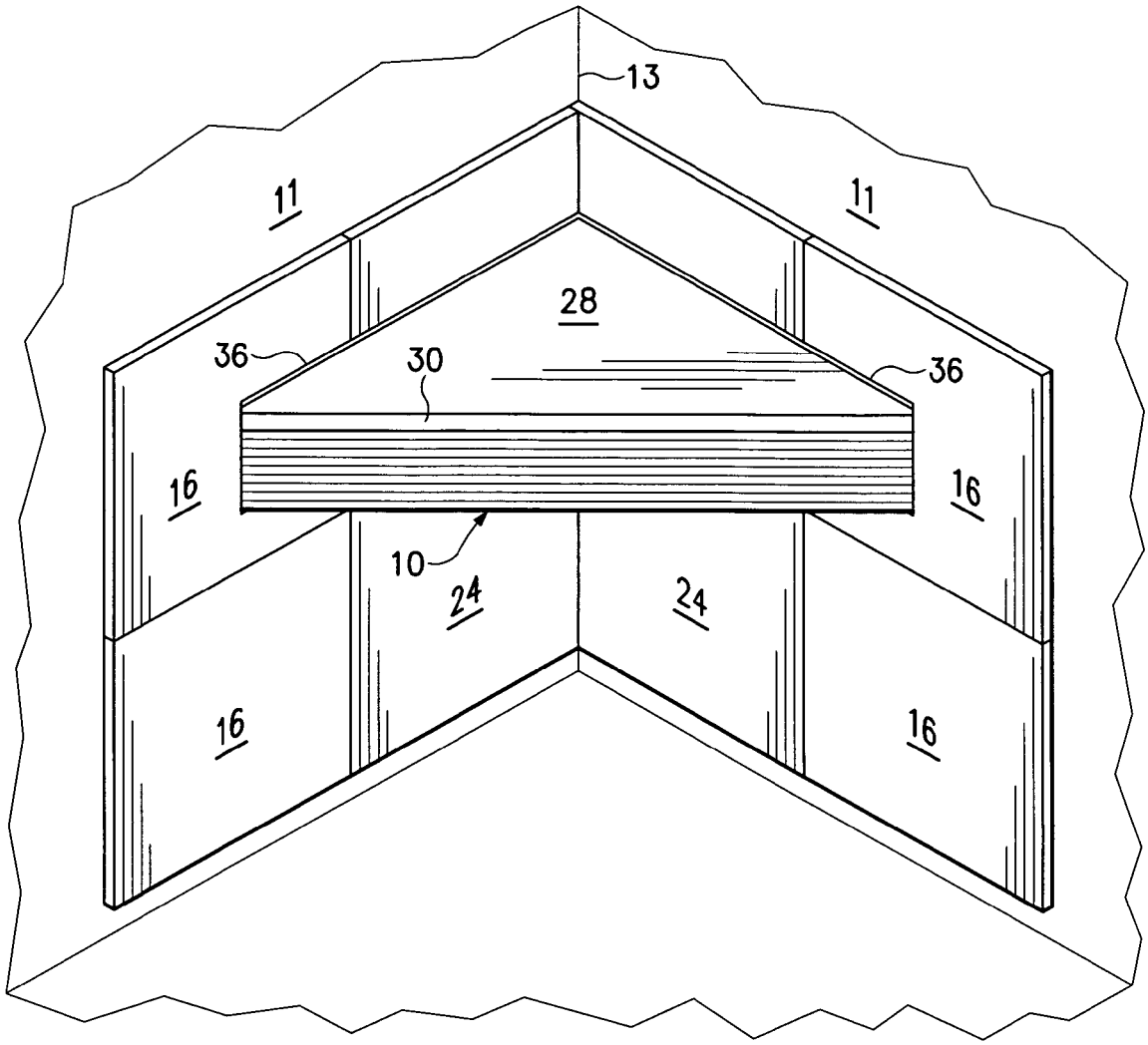

A thin rectangular platform 28, FIG. 5, has adhesive 22 applied to its edges and is placed on top of the beam 10 and the upwardly facing horizontal edges 26 of the tile pieces 24. The platform 28 is made of a rigid material capable of carrying a load, such as cement board. The platform is sized such that its front edge 30 is flush with the front 34 of the beam 10 when its side edges 32 are in contact with the walls 11. Referring to FIG. 6, the platform 28 has a thickness that allows it to fit within the slots 20 in the tile pieces 16 with a small gap 36 remaining between the top of the beam and the top of the slot 20, which is comparable to the space between tiles so that it can be filled with grout.

The ridges 14 in the beam become filled with the adhesive to form a more permanent bond with the platform 28 placed on top of the beam and the tile placed on the front of the beam.

Figure 8:
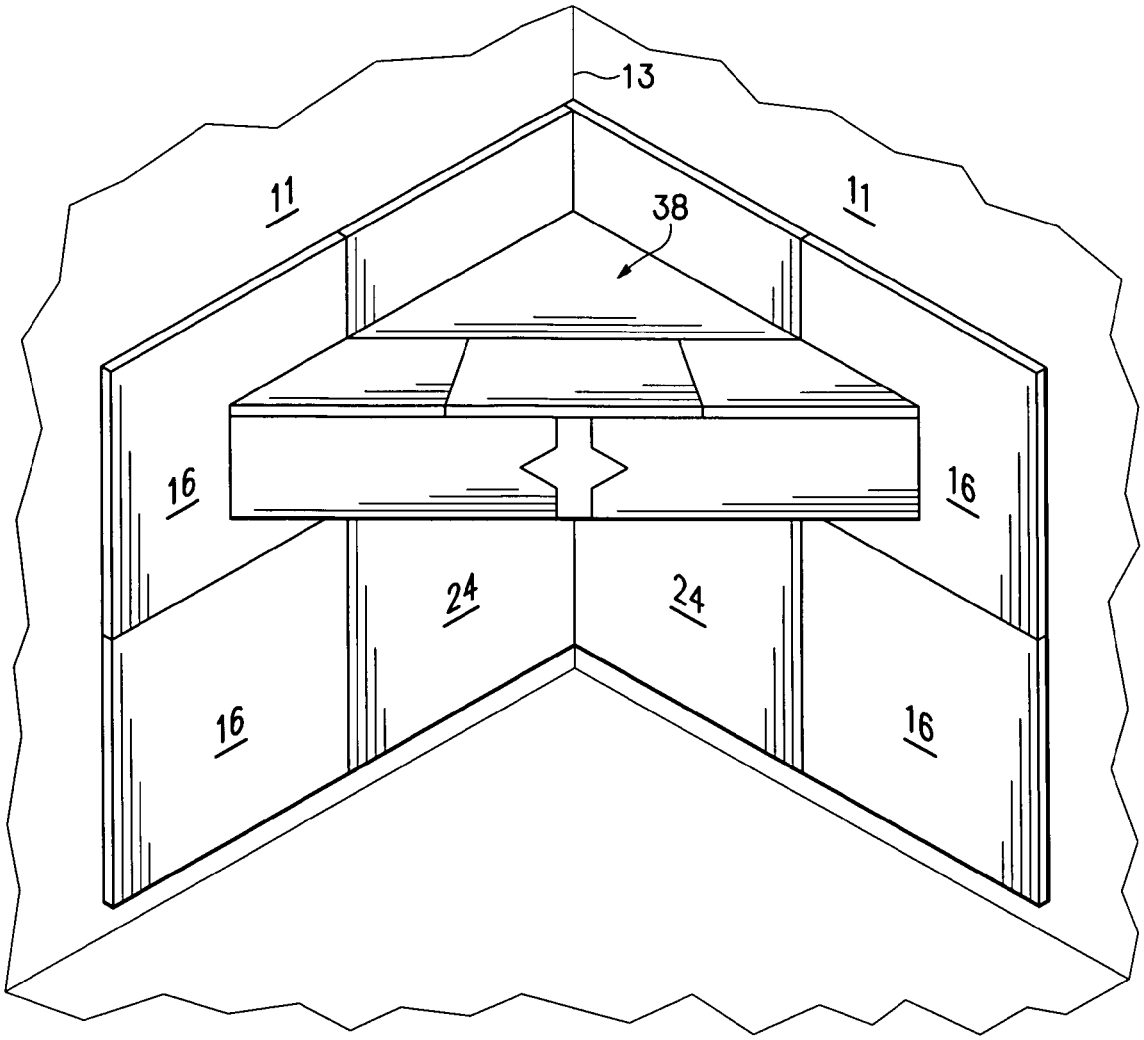

Tile is then placed on the rest of the shower walls as desired, FIG. 8. This can result in a completely or partially tiled shower. Tile is also placed on the top of the platform 28 and the front 34 of the beam.

The resulting corner bench 38 has sufficient strength for someone to sit on it, although benches of this type generally are not used for this purpose.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A method for making a corner bench in a tiled shower, comprising:

(a) providing a beam which extends diagonally between adjacent walls which form the corner the bench is to be located in;

(b) supporting opposed ends of said beam on upwardly facing horizontal edges of tile pieces attached to said adjacent walls;

(c) placing tile pieces having horizontal upper edges which are coplanar with a top surface of said beam on said adjacent walls;

(d) placing a platform on top of said horizontal upper edges and on top of said top surface of said beam; and (e) placing additional tile pieces on remaining portions of the walls of said shower, on the top of said platform and on the front of said beam.

2. The method of claim 1 wherein said beam is a hollow, rectangular cross-sectioned beam.

3. The method of claim 2 wherein said beam is made from a plastic material.

4. The method of claim 2 wherein said beam is square in cross-section.

5. The method of claim 1 wherein said beam has a top surface and a front surface and ridges run longitudinally along said top and front surfaces.

6. The method of claim 5 wherein said ridges are truncated triangles in cross-section.

7. The method of claim 1 wherein the ends of said beam are affixed to said walls by an adhesive.

8. The method of claim 1 wherein the ends of said beam are affixed to said upwardly facing horizontal edges by an adhesive.

9. The method of claim 1 wherein said platform is attached to said horizontal upper edges by an adhesive.

10. The method of claim 1 wherein said upwardly facing horizontal edges are located at the bottoms of slots located in said tile pieces.

11. The method of claim 1 wherein additional tile pieces are affixed to the top of said platform and the front of said beam by an adhesive.

12. An apparatus for making a corner bench in a tiled shower, comprising:

(a) an elongate beam which extends diagonally between adjacent corner walls of said shower;

(b) a triangular platform having a first margin which rests on said beam and second a third margins which rest on horizontal upper edges of tile pieces which are attached to said walls; wherein said beam is supported by upwardly facing horizontal edges of tile pieces which are attached to said walls.

13. An apparatus of claim 12 wherein said beam is a hollow, rectangular cross-section beam.

14. The apparatus of claim 12 wherein said beam is square in cross-section.

15. The apparatus of claim 12 wherein said beam has a top surface and a front surface having ridges running laterally along them.

16. The apparatus of claim 15 wherein said ridges are inverted truncated triangles in cross-section.

* * * * *